US006244466B1

(12) United States Patent
Näslund

(10) Patent No.: US 6,244,466 B1
(45) Date of Patent: Jun. 12, 2001

(54) PACKAGING CONTAINER AND A METHOD OF ITS MANUFACTURE

(76) Inventor: Ingemar Näslund, Vassvägen 21, S-141 39, Huddinge (SE)

( * ) Notice: Subject to any disclaimer, the term of this patent is extended or adjusted under 35 U.S.C. 154(b) by 0 days.

(21) Appl. No.: 09/214,709

(22) PCT Filed: Jul. 8, 1997

(86) PCT No.: PCT/SE97/01182

§ 371 Date: Jan. 11, 1999

§ 102(e) Date: Jan. 11, 1999

(87) PCT Pub. No.: WO98/01354

PCT Pub. Date: Jan. 15, 1998

(30) Foreign Application Priority Data

Jul. 10, 1996 (SE) ..... 9602739

(51) Int. Cl.[7] ..... B65B 1/04

(52) U.S. Cl. ..... 222/94; 141/114

(58) Field of Search ..... 222/94; 141/114, 141/9, 100–103

(56) References Cited

U.S. PATENT DOCUMENTS

| | | |
|---|---|---|
| 5,137,154 | 8/1992 | Cohen . |
| 5,489,464 | 2/1996 | Bjorck . |

FOREIGN PATENT DOCUMENTS

| | | |
|---|---|---|
| 0 621 208 | 10/1994 | (EP) . |
| 2 218 964 | 11/1989 | (GB) . |
| 96/01775 | 1/1996 | (WO) . |

*Primary Examiner*—Steven O. Douglas
(74) *Attorney, Agent, or Firm*—Larson & Taylor, PLC

(57) ABSTRACT

A substance packaging container, preferably for packaging a liquid or powder substance, includes a sealed first chamber (4) for the substance (6) to be packaged. The substance chamber (4) is comprised of a flexible material, such as a foil material. The container also includes a sealed, rigid second chamber (8) which is disposed inside the substance chamber (4).

20 Claims, 3 Drawing Sheets

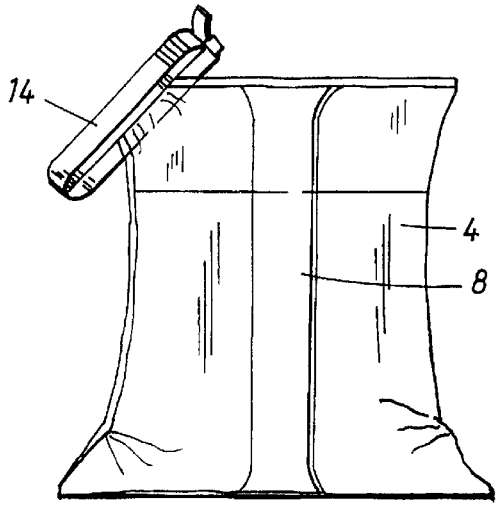
Fig. 4
Fig. 5a
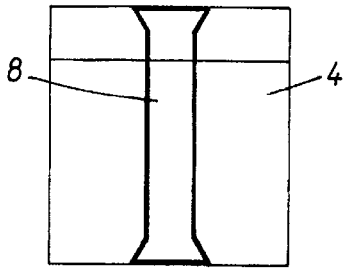
Fig. 5b
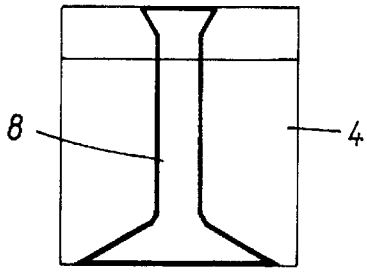
Fig. 5c
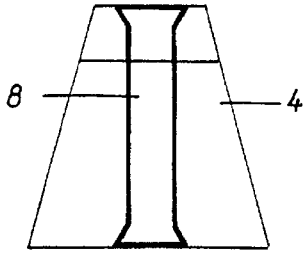
Fig. 5d
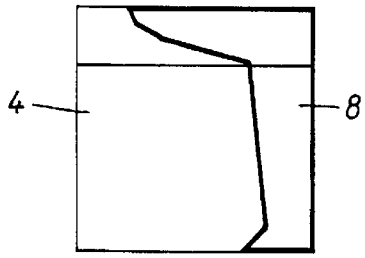

PACKAGING CONTAINER AND A METHOD OF ITS MANUFACTURE

FIELD OF INVENTION

The present invention relates to a substance packaging container, preferably for a liquid and/or powder substance. The packaging container is designed to be an environment-friendly and user-friendly product that can be produced cheaply. The invention also relates to a method of manufacturing such a packaging container.

BACKGROUND ART

Foil and film are being used to to ever increasing extents as product packaging materials. These materials include evaporation-inhibiting barrier layers that keep the contents of the package in a completely sealed environment. Packaging intended for products that are not shape-stable in themselves, for instance liquid or powder products, are made of a thicker material, for instance from different types of laminates. These materials provide the packaging with the rigidity required to enable the packaging to be stored, transported and handled and so that the end user of the package will be able to pour-out the packaged contents or to empty the package of its contents. These packaging materials are often relatively heavy in relation to the contents of the packaging container, which is disadvantageous in several respects. Moreover, these packaging containers are not environmentally adapted, since the laminates are comprised of different layers of material that are difficult to recover. The packaging containers also take-up large volumes of space in conjunction with garbage, or refuse, collection.

From an environmental aspect, it is therefore desirable to depart from the use of thick laminates as packaging materials and to use, e.g., foils of smaller thicknesses instead. The use of such thin material thicknesses is counteracted, however, by the requirement of being able to store, transport and handle the packaging containers. When liquids are packed in thin foil bags, it is difficult to handle the bag and its contents per se in a controllable manner. For instance, when lifting such a bag with the intention of emptying the bag of its contents, care must be taken not to squeeze the bag so as to cause its contents to gush uncontrollably through the bag opening.

It is known to produce liquid packaging containers from flexible foil material and to provide the containers with stiffened packaging walls. For instance, it is known from EP A1 0621 208 to produce a packaging container from a flexible material, such as foil, with foil walls that are comprised of double foil layers. The two foil layers are joined together or laminated punctiformly and/or linearly such as to form in the packaging wall a plurality of mutually connected chambers or passageways. The system of chambers or passageways is filled with air or some other gas and sealed, thereby stiffening the wall of the packaging container. A similar foil packaging container for liquids is known from WO 96/01775. This packaging container also includes walls comprised of double foil layers that are mutually joined (laminated) in a manner such that non-laminated, longitudinally extending parts extend from one side of the packaging container to the other. The non-laminated part forms longitudinally extending pockets that are filled with air and then sealed, therewith stiffening the wall of the packaging container.

One serious drawback encountered with the known foil packaging containers is that the packaging walls are not rigid enough to withstand the external pressure that is applied to the packaging container when handling the container and emptying out its contents, or when resealing the container. For instance, it is not possible to grip and lift the packaging container in a normal manner without exerting pressure on the container contents and causing said contents to spill over the opening defining edge of the container. Neither can the packaging container be emptied in a controllable fashion.

Another disadvantage with the known packaging containers is their vulnerability. For instance, the outer foil of the packaging container wall can be readily damaged and therewith cause a lowering of the pressure in the stiffening chambers, wherewith the packaging container completely loses its rigidity. Neither can the known packaging containers be resealed without risk of damaging the packaging walls.

Although the packaging containers are produced from simple and inexpensive materials, such as foils, these packaging containers are nevertheless encumbered with the serious drawback of being complicated and therefore expensive in manufacture.

SUMMARY OF THE INVENTION

The invention is based on the concept of solving the afore-said problems with a packaging container that fulfils the requirements of being light in weight, of being environmentally friendly and that can be handled, emptied and resealed in a user-friendly fashion in the absence of spillage. The packaging container shall also be easy to manufacture, and thus inexpensive, and easy to fill.

This aim is achieved in accordance with the invention with a packaging container and with a method of producing and filling a packaging container of the kind defined in the introduction and that have the characteristic features set forth hereinafter.

By constructing in accordance with the invention a packaging container that has an inner and stiff chamber disposed in the chamber comprised of flexible material, there is achieved a combination of important advantages which enable the packaging container to function effectively in all states, namely when it is manufactured, filled, stored, kept, opened, emptied either partially or completely, resealed and thrown away.

Manufacture is effective simply and effectively from running webs of foil material, wherein the foil webs are shaped and inter-joined to form running tubular structures that are joined together and filled successively with the aid of nozzles that discharge into the tubes.

The flexible chamber is preferably only filled to a given part of the maximum volume of the packaging container. This is effected by squeezing the flexible chamber together from the sides thereof, such as to reduce the volumetric capacity of the chamber. The flexible packaging containers are therewith able to adapt their shape to the surroundings, which enable several packaging containers to be stacked in collecting containers with the maximum use of the total volume of said containers.

The inventive packaging container, which is produced from a flexible material, has an intrinsic stability and stiffness that enables the container to stand upright in storage, either in an unopened condition or in an opened condition. The packaging container is well-suited for storing substances that are used progressively, such as different types of foodstuffs, for instance.

One important advantage afforded by the inventive packaging container is that the container can be gripped and lifted with one hand without squeezing out its contents. The inner stiffening chamber exerts a counterpressure which withstands the pressure of the hand or fingers against the container when handling the same. The packaging container can thus be gripped with one hand without affecting the container contents.

Another important function of the inner stiffening chamber of the inventive packaging container is that it expands and presses apart the thin foil in the material chamber, so as to form a stable pouring spout. This enables the contents of the packaging device to be emptied in a controlled fashion.

The packaging container is opened conveniently by cutting away one corner of the thin material chamber. This enables the packaging container to be easily resealed to provide a completely tight closure with the aid of a resealing clip which can be used several times and which sealingly compresses the thin foil between its legs.

After emptying the packaged substance from the substance chamber, the stiffening chamber can be readily punctured or emptied of its contents, thereby enabling the packaging material to be compressed to a minimum volume. The packaging material is light in weight and can be readily sorted and recovered with respect to garbage collection.

The volume of the stiffening chamber can also be used for supplementary storage of the packaged substance or for separate storage of another substance that shall be mixed with the substance stored in the substance chamber prior to use and prior to emptying the container.

Other advantageous characteristic features of the invention will be evident from the following description of exemplifying embodiments of the invention.

BRIEF DESCRIPTION OF THE ACCOMPANYING DRAWINGS

The invention will now be described in more detail with reference to chosen exemplifying embodiments thereof and also with reference to the accompanying drawings, in which FIGS. 1*a*–1*b* are respective elevation views of a preferred embodiment of the invention and illustrate the inventive principles;

FIG. 4 illustrates a resealed packaging container according to FIG. 1;

Figure 5E:
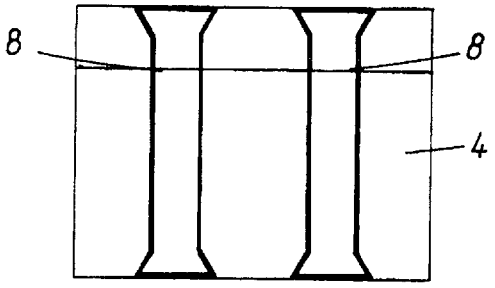
Figure 5F:
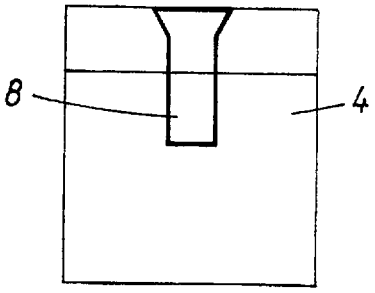
Figure 6:
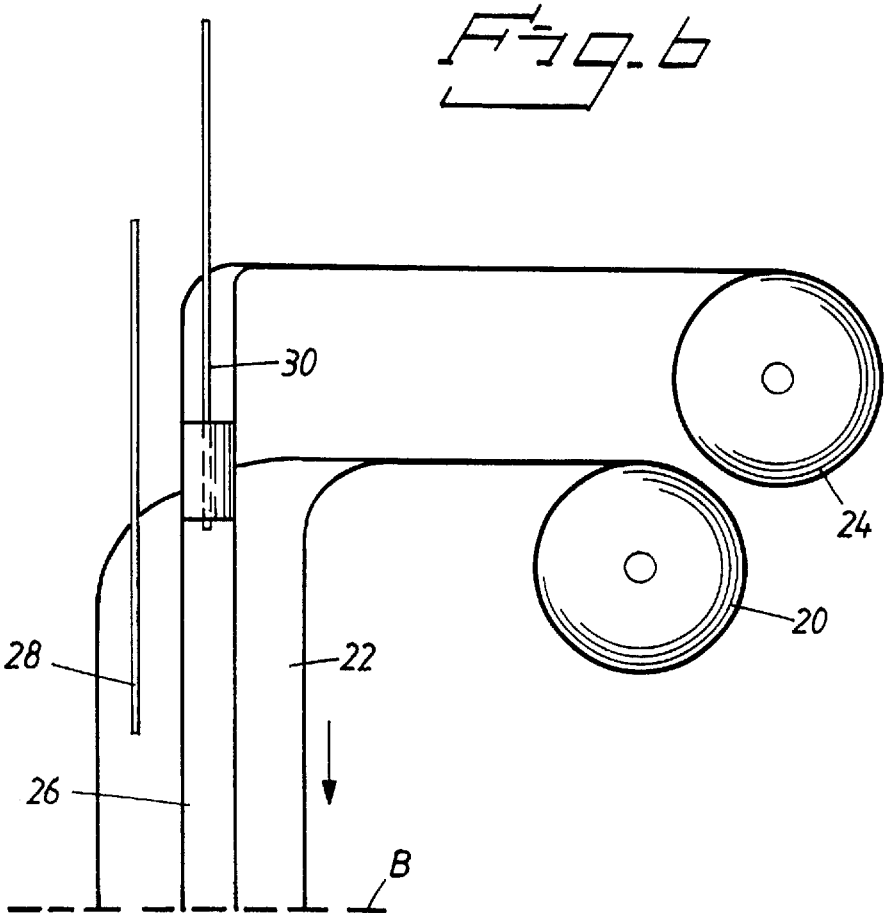

FIGS. 5*a*–5*f* are principle illustrations of different exemplifying embodiments of the invention; and FIG. 6 is a principle illustration of a method of manufacturing and filling a packaging container according to FIG. 1.

DETAILED DESCRIPTION OF PREFERRED EMBODIMENTS OF THE INVENTION

Figure 1A:
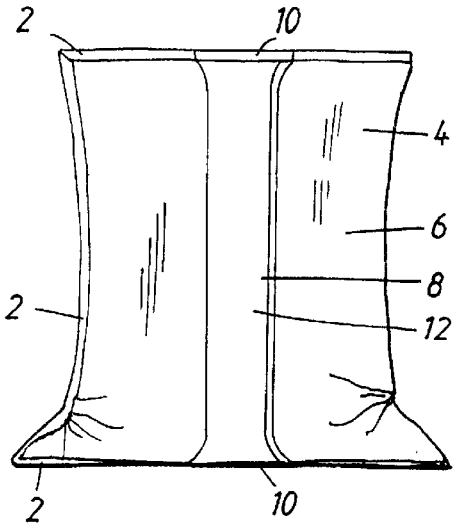
Figure 1B:
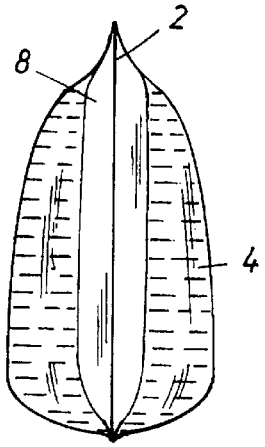

FIGS. 1*a*–1*b* illustrate a first preferred embodiment of an inventive packaging container as seen from the front and from one side thereof. The packaging material is flexible and comprises a thin plastic foil that includes a barrier layer which is effective against evaporation. The foil may comprise a single laminate foil having barrier layer properties against diffusion of gas or liquid. The packaging container may alternatively be produced from other materials, such as different types of plastic materials and plastic foils, aluminium foils or other suitable materials and combinations thereof.

The packaging unit shown in FIGS. 1*a*–1*b* includes a substance packaging chamber 4, which may be welded at the edge parts 2, for instance. The packaged substance 6, which may be a liquid, a powder, a granular material or some other pourable substance that lacks intrinsic shape stability, is enclosed in the substance chamber 4. The substance chamber 4 is preferably not filled to its maximum volume. The outer shape of the packaging container is thus flexible and can be adapted to the surroundings, for instance when a plurality of packaging containers shall be packed together in larger units, such as in a cardboard box. The packaging containers can thus be stacked in the cardboard box while using the volumetric capacity of the box to its maximum. When the packaging container is opened, air is sucked in to the substance chamber and the liquid level falls beneath the level of the container opening as a result of expansion of the substance chamber. This avoids spillage through the container opening.

The packaging container includes a second chamber 8 which is located inside the substance chamber 4 and, in the embodiment illustrated in FIG. 1, is attached to the upper and/or lower edge parts 2 of the packaging container. The second chamber 8 is comprised of a flexible material, in this case of the same material as the substance chamber 4, and has three mutually joined edge parts 10, e.g. mutually welded edge parts, of which two coincide with the edge parts 2 of the substance chamber 4. It lies within the scope of the invention to produce the substance chamber 4 and the second chamber 8 from different materials, although alternatively with mutually different thicknesses.

The second chamber 8 forms a container stiffening or supporting chamber by virtue of being closed and filled either completely or partially with a substance 12. This substance produces an internal pressure against the flexible material in the walls of the stiffening chamber 8, causing the walls to erect and afford rigidity to the chamber 8. The substance 12 in the stiffening chamber 8 may be air or some other gas, a liquid, a powder, a stabilizing plastic foam or some other suitable material, or may be comprised of a combination of gas, liquid or some other material. The substance 12 is preferably delivered to the chamber 8 at the same time as the substance 6 is delivered to the substance chamber 4. The substance 12 may alternatively be delivered to the chamber 8 at an earlier or later stage, with the aid of a valve means (not shown) included in the packaging container, for instance by the final customer.

Figure 2:
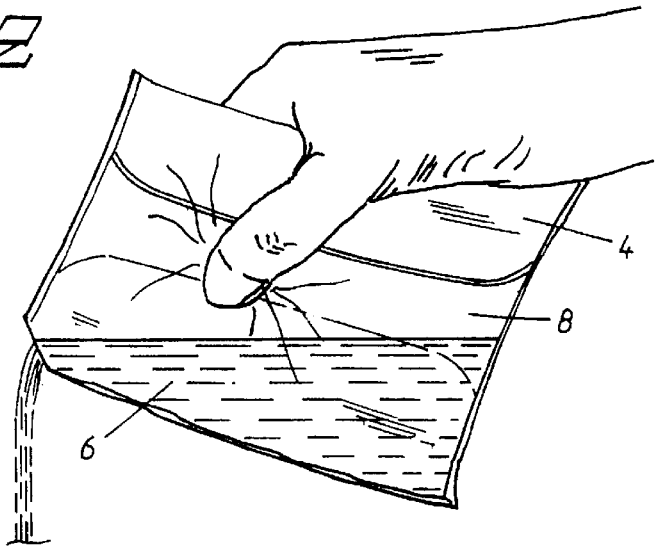
FIG. 2 illustrates the packaging container of FIG. 1 in a pouring position.
Figure 3:
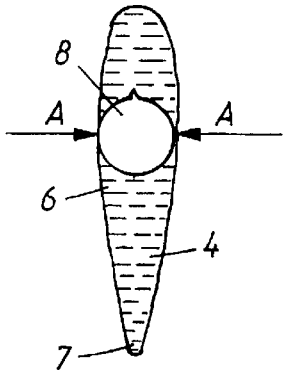
FIG. 3 is a cross-sectional view of an open packaging container according to FIG. 1 and shows a pouring action.

FIGS. 2–4 illustrate the manner of use of the packaging container shown in FIG. 1. The stiffening chamber 8 supports the packaging container when handling the container and forms a stable handgrip when pouring from the container and emptying its contents (see FIG. 2). The packaging container is opened suitably by cutting away part of one corner of the container. In spite of the thin and flexible packaging material, the packaging container is held erect and expanded by the stiffening chamber 8, so as to enable the container to be opened without risk of the packaged substance 6 running out in an uncontrolled fashion.

FIG. 2 shows that the contents of the packaging container can be emptied therefrom either completely or partially in a controlled fashion. The user grips the stiffening chamber 8, which functions as a handgrip (see the arrows in FIG. 3). Thus, the gripping pressure on the packaging container necessary in handling the container is applied essentially to the stiffening chamber 8 and not to the substance contained in the substance chamber 4. This avoids pressure on the substance 6 enclosed in the substance chamber and subsequent uncontrolled pouring of said substance.

It will be evident from FIG. 3 that the stiffening chamber 8 has a thickness which enables the wall of the substance chamber to be pressed out on both sides of the stiffening chamber 8, thereby to form a generally V-shaped or U-shaped pouring chute 7 with the aid of the pressure exerted by the enclosed substance 6. The thus formed pouring chute 7 enables the packaged substance 6 to be poured from the packaging container either partially or completely without spillage and in a controlled fashion, and also enables small quantities of the packaged substance 6 to be poured from the packaging container. The substance can be poured in a uniform flow in the absence of a subpressure in the substance chamber, as opposed to the case when pouring from a shape stable packaging container in which a pulsating flow occurs as a result of air being sucked in due to the prevailing subpressure. In the case of larger packaging volumes, the packaging container can also be gripped at the wall of the substance chamber when pouring from the container. A stable pouring chute is also formed in this case.

FIG. 4 illustrates how the packaging container can be resealed with a resealing clip 14 suitable to this end. The thin foil material in the wall of the substance chamber is compressed between the two legs of the clip 14, therewith obtaining a tight resealing function.

A packaging container that has been emptied of its contents can be reused by refilling the container and sealing the same with the resealing clip 14. However, the inventive packaging container is particularly designed for use as a disposable container suitable from an environmental aspect. Thus, the wall of the stiffening chamber 8 can be cut up or punctured when the packaging container has been emptied of its contents, so as to allow air or other substance in the stiffening chamber to empty therefrom. All that then remains of the packaging container is the thin flexible plastic foil, which can be compressed to a volumetrically minimum packaging residue without any counteracting tension in the material or self-expansion of the package.

FIGS. 5*a*–5*f* illustrate various embodiments of an inventive packaging container. FIG. 5*a* illustrates the packaging container of FIG. 1 by way of comparison. The inner stiffening chamber 8 of the embodiment shown in FIG. 5*b* is widened at its lower part, thereby enhancing the stability of the bottom part of the container so as to enable the container to stand firmly on a flat supporting surface. FIG. 5*c* shows that the substance chamber 4 of the packaging container can have shapes other than a square or rectangular shape. In the case of this embodiment, the substance chamber 4 is conical in shape, although other shapes are possible within the scope of the invention. FIG. 5*d* shows a stiffening chamber 8 which is located by the side of the substance chamber 4 and which has an outwardly drawn extension at the upper edge of the container. This extension of the stiffening chamber presses-out and stabilizes the upper edge of the substance chamber 4, so as to provide controlled pouring of the container contents from said container. FIG. 5*e* illustrates another embodiment of the inventive packaging container. This embodiment illustrates the possibility of providing the container with a plurality of mutually separate stiffening chambers 8. FIG. 5*f* illustrates an embodiment of the packaging container that includes a stiffening chamber 8 firmly connected to the upper edge of the substance chamber 4. The extension of the stiffening chamber 8 in the vertical extension of the packaging container constitutes only a part of the full height of the container, but is sufficient to extend beneath the level of the packaged substance in the chamber 4. In this case, the stiffening chamber 8 has the function of a float that urges the wall of the flexible substance chamber upwards. The stiffening chamber 8 also functions as a handgrip which takes-up the gripping pressure and causes the substance chamber wall to be expanded so as to form a pouring chute for controlled emptying of the packaging container, in the same way as that described with reference to the other embodiments.

FIG. 6 illustrates a method of manufacturing and filling the packaging container shown in FIG. 1. The substance chamber 4 of the packaging container is formed in a running web taken from a roll 20 of flexible packaging material, for instance a plastic foil material. The chamber is formed by shaping the foil into a chamber-forming tube 22 which is joined longitudinally, preferably welded. A stiffening or supporting chamber 8 is formed in a running web taken from a further roll of material 24, for instance plastic foil material. The stiffening chamber is formed by shaping the foil into a stiffening tube 26 that is joined longitudinally, for instance welded, wherein the stiffening chamber tube 26 extends inside the substance chamber tube 22. A first nozzle 28 through which the packaged substance 6 is fed into the packaging container discharges into the substance chamber tube 22, while a second nozzle 30 through which the stiffening substance 12 is delivered to the stiffening chamber discharges into the stiffening chamber tube 26. The second nozzle 30 may be constructed to sealingly abut the inner surface of the stiffening chamber tube, so as to enable a positive pressure to be generated in the stiffening chamber 8 when the stiffening substance 12 is air or some other gas. A transversal join (at B in FIG. 6), e.g. a weld seam, is formed in the bottom edge of the two tubes 22, 26 prior to the filling phase, said join forming the bottom when filling the tubes from the top thereof, as shown in FIG. 6. The tube pack with the chambers 4, 8 filled completely and/or partially is joined to the upper part of the packaging container, for instance with a weld seam, whereafter a new filling cycle is commenced.

An alternative method of producing an inventive packaging container, for instance a packaging container according to FIG. 5*f*, is to form, fill and seal the stiffening chamber tube in a separate continuous process, whereafter the completed stiffening chambers are fed successively into the substance chamber tube, which is then filled, sealed and joined to the stiffening chamber unit.

It will be understood that the invention is not restricted to the described and illustrated embodiments thereof and that several modifications are conceivable within the scope of the invention defined in the accompanying claims.

For instance, the substance chamber may have different shapes and forms, as described above. The stiffening chamber may also have different forms and the packaging container may be given one or more stiffening chambers that can be disposed in the packaging container in various ways. The stiffening chamber (or chambers) may lie freely in the substance packaged in the substance chamber and be affixed at both ends to the wall of the substance chamber, or only at one end of the chamber wall.

The packaging container may include several stiffening chambers that enclose mutually different substances. A stiffening chamber that shall also function as a handgrip may be filled with air for instance, whereas another stiffening chamber (or several other stiffening chambers) may be filled with a component that shall be mixed with the substance packaged in the substance chamber prior to its use. When the packaging container has been opened, the stiffening chamber, or supporting chamber, containing the mixing component can be cut through the opening in the substance chamber so as to release said component and mix the component with the substance in the substance chamber. The air-filled stiffening chamber can therewith be used as a handgrip in the mixing process and when pouring out the container contents. Naturally, one or more stiffening chambers may be filled with the same substance as that packaged in the substance chamber, wherewith the contents of the stiffening chambers are successively released and mixed with the substance in the substance chamber.

The inventive packaging container may also be constructed from a thicker material when packaging a substance of larger and heavier volume. In this case, the stiffening chamber forms a rigid support in the packaging bag that supports the chamber and creates conditions for controlled pouring of the packaged substance.

What is claimed is:

1. A substance packaging container for a fluid substance comprising:

a first, closed chamber having walls of a flexible material, said first chamber accommodating the fluid substance therein; and at least one sealed second chamber which is rigid and which is disposed inside of said first chamber to support said first chamber in an upright standing position, said second chamber having top and bottom ends and a middle portion therebetween which said middle portion is detached from said walls of said first chamber.

2. A substance packaging container as claimed in claim 1, wherein said walls of said first chamber are made of a foil material.

3. A substance packaging container as claimed in claim 1, wherein said second chamber is made of a flexible material and is at least partially filled with a second substance which stiffens said second chamber.

4. A substance packaging container as claimed in claim 3, wherein said flexible material of said second chamber is a foil material.

5. A substance packaging container as claimed in claim 3, wherein said second chamber is filled with a gas.

6. A substance packaging container as claimed in claim 5, wherein said gas is air.

7. A substance packaging container as claimed in claim 3, wherein said second chamber is filled with one of a liquid, a gas, a powder, a granular material, a foamed plastic, or a combination thereof.

8. A substance packaging container as claimed in claim 3, wherein said flexible material of said first chamber and said flexible material of said second chamber each are a foil material having diffusion blocking properties.

9. A substance packaging container as claimed in claim 1, wherein there are a plurality of said second chambers disposed in said first chamber, said plurality of second chambers being filled with a same substance.

10. A substance packaging container as claimed in claim 1, wherein there are a plurality of said second chambers disposed in said first chamber, said plurality of second chambers being respectively filled with at least two different substances.

11. A substance packaging container as claimed in claim 1:

wherein said first chamber includes top and bottom edges in the upright standing position; and wherein said top and bottom ends of said second chamber are top and bottom edges respectively which are respectively secured to said top and bottom edges of said first chamber.

12. A substance packaging container as claimed in claim 1:

wherein said first chamber includes a top edge in the upright standing position;

wherein the fluid substance extends to a level in said first chamber in the upright standing position; and wherein said top end of said second chamber is a top edge which is secured to said top edge of said first chamber and said middle portion extends below the level of the fluid substance.

13. A substance packaging container for a fluid substance comprising:

a first, closed chamber having walls of a flexible material, said first chamber accommodating the fluid substance therein; and at least one sealed second chamber which is rigid and which is disposed inside of said first chamber to support said first chamber in an upright standing position, said second chamber being elongate and detached from said walls of said first chamber along substantially an entire length thereof.

14. A substance packaging container as claimed in claim 13, wherein said second chamber is made of a flexible material and is at least partially filled with a second substance which stiffens said second chamber.

15. A substance packaging container as claimed in claim 14:

wherein said first chamber includes top and bottom edges in the upright standing position; and wherein said second chamber includes top and bottom edges which are respectively secured to said top and bottom edges of said first chamber.

16. A substance packaging container as claimed in claim 14:

wherein said first chamber includes a top edge in the upright standing position;

wherein the fluid substance extends to a level in said first chamber in the upright standing position; and wherein said second chamber includes a top edge which is secured to said top edge of said first chamber and said second chamber extends below the level of the fluid substance.

17. A substance packaging container for a fluid substance comprising:

a first, closed chamber having walls of a flexible material, said first chamber accommodating the fluid substance therein; and at least one sealed second chamber which is rigid and which is disposed inside of said first chamber to support said first chamber in an upright standing position, said second chamber being discrete from said first chamber such that said discrete second chamber is surrounded by the fluid substance when said first chamber is in the upright standing position.

18. A substance packaging container as claimed in claim 17, wherein said second chamber is made of a flexible material and is at least partially filled with a second substance which stiffens said second chamber.

19. A substance packaging container as claimed in claim 18:

wherein said first chamber includes top and bottom edges in the upright standing position; and wherein said second chamber includes top and bottom edges which are respectively secured to said top and bottom edges of said first chamber.

20. A substance packaging container as claimed in claim 18:

wherein said first chamber includes a top edge in the upright standing position;

wherein the fluid substance extends to a level in said first chamber in the upright standing position; and wherein said second chamber includes a top edge which is secured to said top edge of said first chamber and said second chamber extends below the level of the fluid substance.

* * * * *